US007469939B2

(12) United States Patent
Westman et al.

(10) Patent No.: US 7,469,939 B2
(45) Date of Patent: Dec. 30, 2008

(54) MUFF COUPLING FOR VEHICLE COUPLERS

(75) Inventors: Anders Westman, Falun (SE); Gunnar Jernberg, Borlänge (SE); Mats Eriksson, Borlänge (SE)

(73) Assignee: Dellner Couplers AB, Falun (SE)

( * ) Notice: Subject to any disclaimer, the term of this patent is extended or adjusted under 35 U.S.C. 154(b) by 172 days.

(21) Appl. No.: 10/557,050

(22) PCT Filed: Apr. 27, 2004

(86) PCT No.: PCT/SE2004/000638

§ 371 (c)(1),
(2), (4) Date: Nov. 16, 2005

(87) PCT Pub. No.: WO2004/103790

PCT Pub. Date: Dec. 2, 2004

(65) Prior Publication Data

US 2008/0012335 A1 Jan. 17, 2008

(30) Foreign Application Priority Data

May 26, 2003 (SE) ..... 0301528

(51) Int. Cl.
*F16L 23/00* (2006.01)

(52) U.S. Cl. ..... 285/412; 285/406; 285/419; 285/420

(58) Field of Classification Search ..... 285/104, 285/110–112, 364, 367, 373, 406, 410–412, 285/415, 419–420, 407; 403/289–290, 311–312, 403/344; 464/177, 182
See application file for complete search history.

(56) References Cited

U.S. PATENT DOCUMENTS

| | | | | | |
|---|---|---|---|---|---|
| 1,190,350 | A | * | 7/1916 | Williams | 405/121 |
| 2,065,480 | A | * | 12/1936 | Soper | 285/288.5 |
| 3,964,773 | A | * | 6/1976 | Stade et al. | 285/367 |
| 4,332,404 | A | * | 6/1982 | Huffman | 285/223 |
| 4,522,434 | A | * | 6/1985 | Webb | 285/112 |
| 4,840,026 | A | * | 6/1989 | Nash et al. | 60/770 |
| 4,863,045 | A | | 9/1989 | Altherr | |
| 5,080,400 | A | | 1/1992 | Adamek et al. | |

(Continued)

FOREIGN PATENT DOCUMENTS

EP 0358052 3/1990

*Primary Examiner*—Aaron M Dunwoody
*Assistant Examiner*—Fannie Kee
(74) *Attorney, Agent, or Firm*—Young & Thompson

(57) ABSTRACT

A muff coupling intended for vehicle couplers includes two components formed with ring-shaped flanges, as well as a muff consisting of at least two arch parts tightenable against each other, each having an inner flute formed between two inwardly turned bulges, which flute is delimited by obliquely inclined side surfaces to, upon radial tightening of the arch parts against each other, be pressed against analogously obliquely inclined shoulder surfaces on the flanges and thereby, by wedge action, transfer axial component forces to the same, pressing the ends of the components in close contact against each other. The arch parts are formed with double sets of bulges for cooperation with double flanges on the respective component, whereby forces that are transferred between the components via the muff are distributed to a plurality of axially spaced-apart pairs of contact surfaces in an axial train of forces near the outside of the components.

19 Claims, 4 Drawing Sheets

Figure 1:
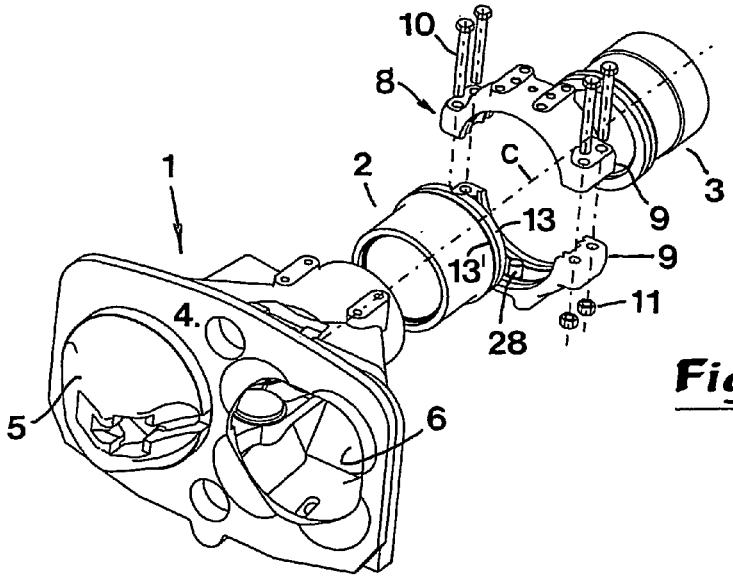

U.S. PATENT DOCUMENTS 6,041,824 A * 3/2000 Powell ..... 138/109
2002/0074802 A1* 6/2002 Feichtinger ..... 285/415
2003/0197381 A1* 10/2003 Lehnhardt ..... 285/364

* cited by examiner

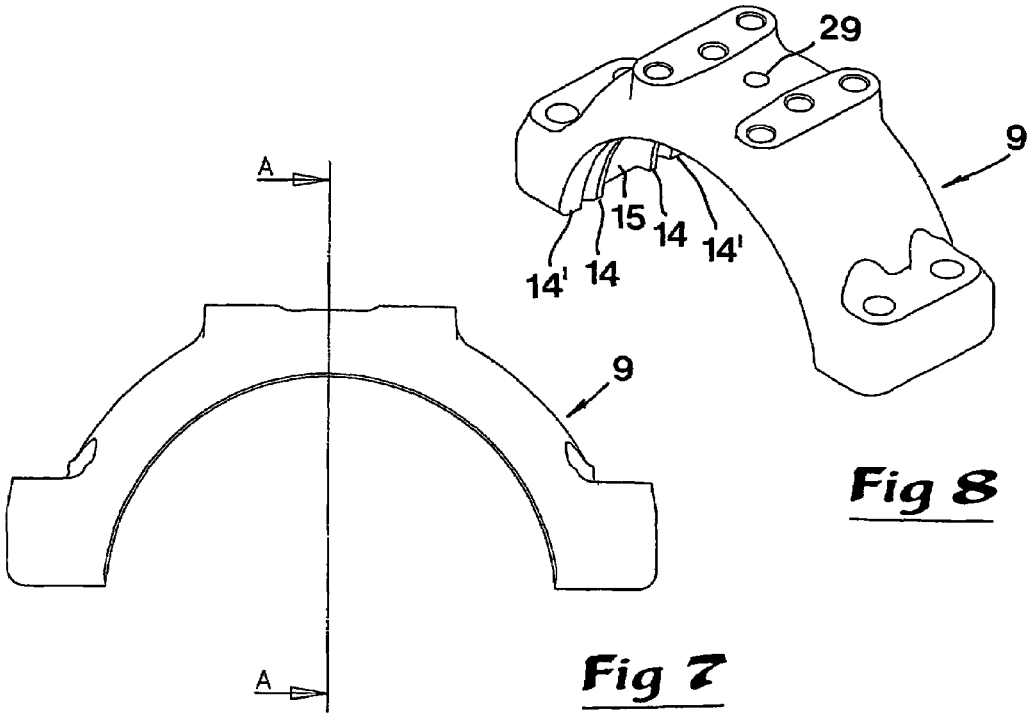
Fig 8
Fig 7
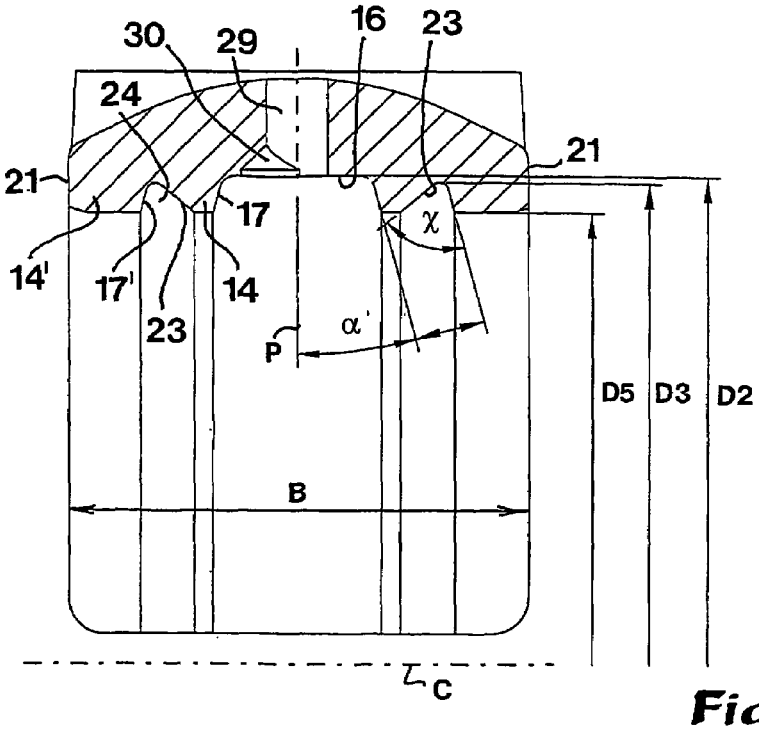
Fig 9

MUFF COUPLING FOR VEHICLE COUPLERS

TECHNICAL FIELD OF THE INVENTION

This invention relates to a muff coupling intended for vehicle couplers of the type that comprises two components, formed with ring-shaped flanges, and interconnectable via a muff comprising of at least two arch parts tightenable against each other, each of which separately has an inner flute formed between two inwardly turned bulges, which flute is delimited by a bottom and two opposite, force-transferring side surfaces, which are obliquely inclined in order to, upon radial tightening of the arch parts against each other, be pressed against analogously obliquely inclined shoulder surfaces on the flanges of the components and thereby, by wedge action, transfer axial component forces to the same with the purpose of pressing the ends of the components in close contact against each other.

BACKGROUND OF THE INVENTION

Couplers having muff couplings of the kind generally mentioned above are used above all for the coupling of rail-mounted vehicles of different types, e.g., carriages or wagons and/or locomotives in train units. More precisely, each end of the individual carriage is connected with a coupler, which can be coupled together with a compatible coupler in the nearby carriage in the train unit. In the modern railway technology, only automatic or semi-permanent central couplers are in all essentials used in which the requisite damping function between the carriages is integrated, i.e., the carriages lack separate dead blocks. In one respect, the couplers may be divided into two main types, viz. a simpler type that utilizes hooks as coupling elements, and a more sophisticated type that makes use of more complicated latch mechanisms.

Common to all types of modern couplers is that they are manufactured by a specially adapted modular structure so far that the couplers—in order to provide for different purchasers' individual needs and wishes—are put together from a variety of different components of standard type as well as special designs, this providing finished couplers having highly varying properties in respect of, for instance, inherent strength, length, force transfer capacity (tension and compression, respectively), shock absorbing capacity, crash absorption capacity, price, service friendliness, possibilities to repair, etc. The need for specially adapted manufacture is particularly marked in the light of the fact that only a few actors serve the entire world market for couplers and that the railway traffic in the different countries of the world is controlled by national rules and regulations of shifting character, e.g., in respect of security, speed, travel comfort, timetable reliability, topography of landscape, etc. Therefore, the components that are found in the couplers vary in number and nature. Thus, in central couplers, there may be included, according to the individual specification of requirements from the purchaser, in addition to a head, for instance, shock absorbers or dead blocks, length-determining extension or spacing collars, crash-absorbing deformation tubes, leading anchors, pivot brackets and the like.

PRIOR ART

In order to reliably connect the components in question with each other, muff couplings of the type that has been mentioned by way of introduction has since long been used. Muff couplings may also be found in the interface between two cooperating couplers, viz. when the same are of a semi-permanent type. Previously known muff couplings for rail vehicle couplers are, however, associated with annoying disadvantages. One such disadvantage is that the couplings have a considerable weight and are ungainly. This is due to the fact that each one of the two arch parts or halves, which together form a surrounding muff, has to be formed with two very strong bulges in order to resist and carry the tensile and compressive stresses, respectively, which the same alternatingly are exerted to in connection with different driving situations, e.g., acceleration, jerky journey, braking, etc., and for intermittently transferring considerable dynamic forces to and from the end flanges on the components in a complicated and varying interaction of forces. Therefore, the known muffs have a width of about 120 mm and weigh about 12 kg (6 kg per arch part), the individual, inner bulge having a width of approx. 30% of said total width.

Also the end flanges, which by wedge action are pair-wise clamped between the two inner bulges of the muff, are comparatively big, above all in respect of the thickness thereof, (i.e., the radial measure by which the same project from the otherwise cylindrical envelope surfaces of the components). In spite of the muff and the bulges thereof as well as the end flanges on the coupled components co-operating with the same being strong and weight-swallowing, the capacity of the established coupling joint to transfer the dynamic forces in a train of forces from one component to the other is, however, not optimal. Thus, the transfer of force between the individual component and the muff takes place via one single interface in the form of the two chamfered or conical contact surfaces that are pressed against each other. These contact surfaces have a moderate area and are located fairly far out from the centre of the coupling joint seen in the radial direction. Therefore, the lines of force that permanently act axially to and fro in the proper components are forced out into fairly abrupt curves upon the passage thereof via the coupling joint.

A particularly annoying consequence of the structurally strong embodiment of the muff couplings is that they are weight-swallowing so far that each kilogram of extra weight reduces net loading capacity of the vehicles correspondingly. Because each coupler may include a plurality of muff couplings and each carriage in a train unit demands two couplers, the net loading reduction in total may become considerable.

OBJECTS AND FEATURES OF THE INVENTION

The present invention aims at obviating the above-mentioned disadvantages of previously known muff couplings for vehicle couplers and at providing an improved muff coupling. Therefore, a primary object of the invention is to provide a muff coupling that is light and formed for transferring occurring dynamic forces in a strength-wise expedient train of forces from one component to the other. It is also an object to provide possibilities for, if required, increasing the active area of the contact surfaces via which transfer of force takes place, with the outmost object of improving the strength and reliability of the muff coupling. In a particular aspect, the invention aims at providing a muff coupling that in a universal way enables coupling of not only components having one and the same type of connecting flanges, but also components having end flanges of different types. It is also an object to provide a muff coupling that is easy to handle in connection with repairs and maintenance.

According to the invention, at least the primary object is attained by the features that are defined in the characterizing clause of claim 1. Preferred embodiments of the muff coupling according to the invention are furthermore defined in the dependent claims.

BRIEF DESCRIPTION OF THE APPENDED DRAWINGS

Figure 2:
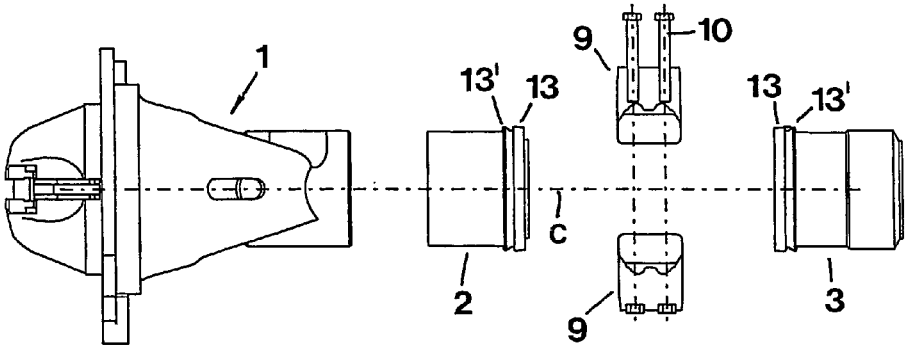
Figure 3:
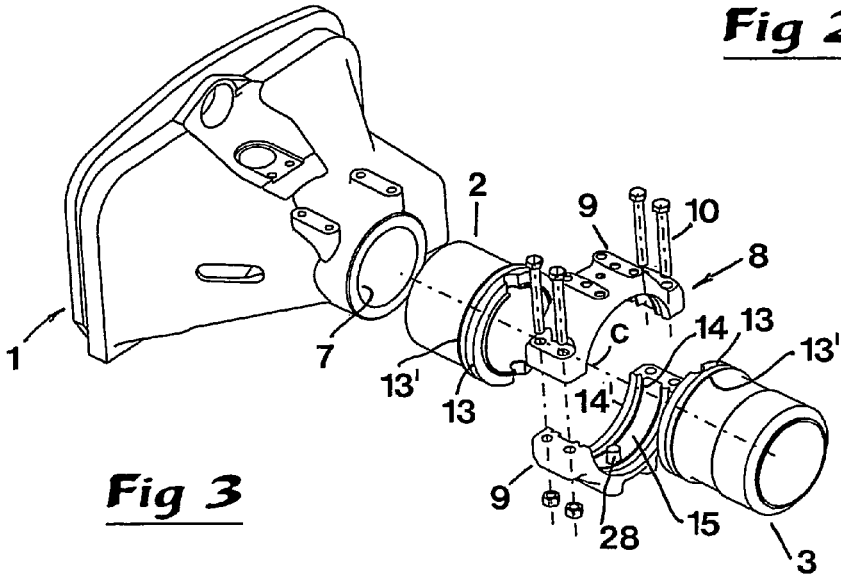
Figure 4:
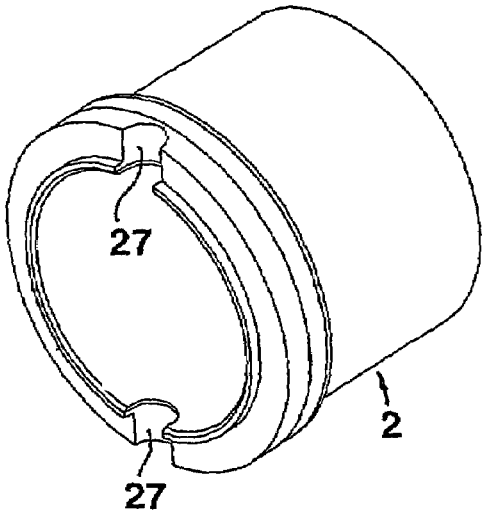
Figure 5:
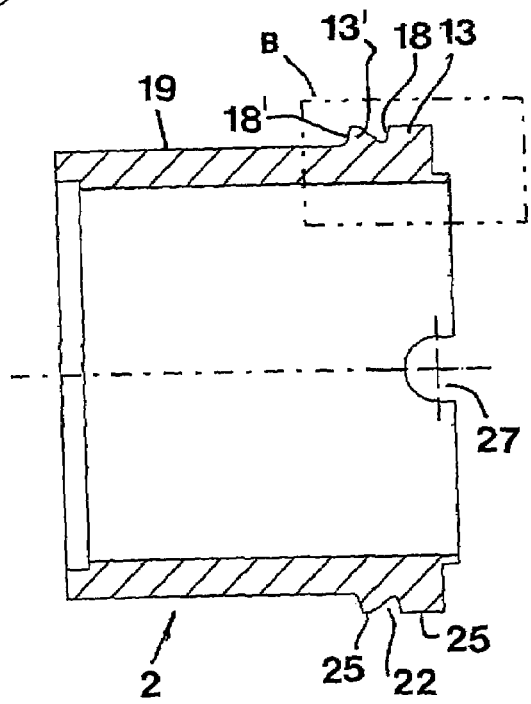
Figure 6:
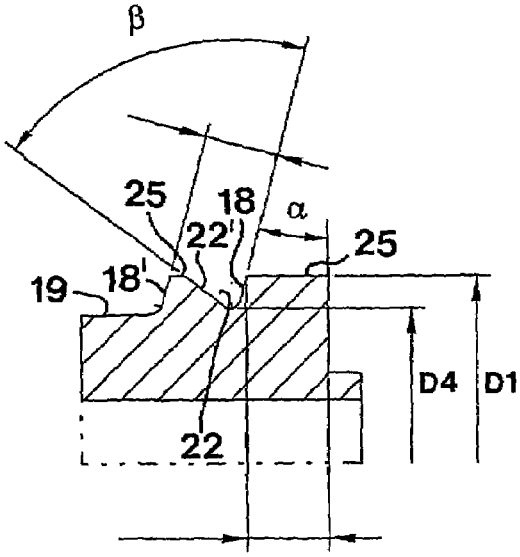
Figure 10:
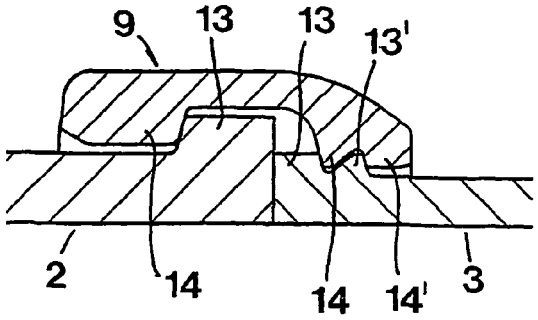
Figure 11:
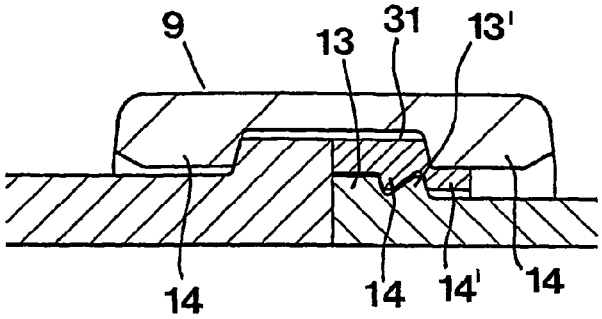
Figure 12:
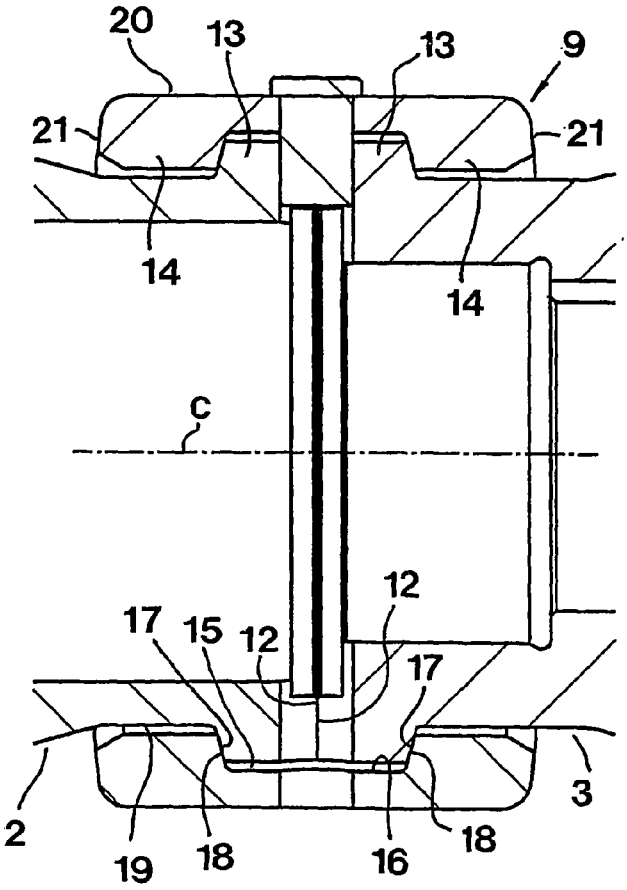
Fig 12 (PRIOR ART)

In the drawings:

FIG. 1 is a perspective exploded view of a coupler provided with a muff coupling according to the invention seen obliquely from the front, FIG. 2 is a an exploded view of the same coupler seen from the side, FIG. 3 is a perspective exploded view of the coupler seen obliquely from behind, FIG. 4 is a perspective view of an individual component, more precisely in the form of an extension tube, included in the muff coupling, FIG. 5 is a longitudinal section through the tube according to FIG. 4, FIG. 6 is an enlarged detailed section B in FIG. 5, FIG. 7 is a front view of an arch part, which constitutes one of the halves of a muff included in the muff coupling, FIG. 8 is a perspective view of the arch part according to FIG. 7, FIG. 9 is an enlarged section A-A through the arch part according to FIG. 7, FIG. 10 is a schematic longitudinal section through an alternative muff coupling, FIG. 11 is an analogous section through a third, alternative embodiment of the muff coupling, and FIG. 12 is a schematic section through a muff coupling according to prior art.

DETAILED DESCRIPTION OF PREFERRED EMBODIMENTS OF THE INVENTION

In FIGS. 1-3, an individual coupler is visualised, which includes a front, house-like head 1, as well as two part components 2, 3 that in the composed state of the coupler are connected mutually—as well as with the head 1. In the example in question, the coupler consists of an automatic coupler, the head of which on the front side 4 thereof is formed with a male-like projection 5, as well as a female-like seating 6, in the house a ratchet mechanism being built-in that enables coupling of the coupler with a compatible coupler on a nearby carriage, more precisely by the male element 5 being inserted into a corresponding seating 6 in the co-operating coupler (and vice versa). In the back side of the head 1, a circular opening 7 is formed to which the component 2 may be connected and fixed. In the example, the component 2 consists of a distance tube or extension tube, the main function of which is to finally decide the total length of the finished coupler. The tube 2 has a rotationally symmetrical, more precisely a cylindrical basic shape and is concentric with the centre axis C of the coupler. Fixation of the tube 2 in relation to the head 1 may be carried out in various ways. However, welding is preferred (involving that the joint between the head and the tube becomes generally permanent, i.e., not releasable). Also the second component 3 consists of a tube, for instance an energy-absorbing tube, which has the purpose of carrying impulse forces or percussion forces in connection with possible crashes. In the composed coupler, the tubes 2 and 3 are releasably connected to each other, more precisely by means of a muff in its entirety designated 8. The same muff includes in the usual way two arch parts 9, which may be inter-connected via a bolt joint, which in the example includes four bolts 10 together with the appurtenant nuts 11.

Before the invention is further described, reference is made to FIG. 12 that illustrates a muff coupling according to prior art. Also in this case, two arch parts 9 are included in the muff by means of which the two ring-shaped end surfaces 12 facing each other on two tubes 2, 3, may be pressed against each other in close contact. For this purpose, the arch parts co-operate with ring-shaped end flanges 13 on the respective tube. Inwardly from the generally semi-cylindrical arch part 9, two bulges 14 extend, between which there is a flute or countersink 15, which is delimited by a semi-cylindrical bottom surface 16 and two opposite, force-transferring side surfaces 17 having a conical basic shape. Regarded in cross-section, the flute 15 is substantially U-shaped, the two side surfaces or flank surfaces 17 forming an obtuse angle to the bottom surface 16. The obtuse angle may be within the range of 100-110°. In an analogous way, the two end flanges 13 are formed with obliquely inclined or conical surfaces 18 below said shoulder surfaces. The angle between the same shoulder surfaces 18 and the centre axis C is substantially the same as the angle between the side surfaces 17 and the centre axis. The outer diameter of the end flanges 13 is somewhat smaller than the inner diameter of the bottom surface 16 so that a play of at least some millimetres is formed between the outside of the flanges and the inside of the flute when the arch parts are tightened. In an analogous way, the inner diameter of the bulges 14 is somewhat larger than the outer diameter on the envelope surfaces 19 of the tubes 2, 3, so that play is established between the insides of the bulges and the envelope surfaces of the tubes. In other words, there is surface contact between the muff and the tubes solely in the interfaces between the force-transferring cone surfaces 17, 18.

Outwardly, the two arch parts are defined by a semi-cylindrical, external envelope surface 20, as well as two ring-shaped end surfaces 21.

In FIG. 12, with the naked eye it is seen that the two inwardly turned bulges 14 are solid, so far that their width (regarded in the cross-section) occupies a large part of the total width of the arch part such as this is counted between the end surfaces 21. More precisely, the width of the individual bulge occupies approx. 30% of the total width. As has been mentioned previously, the total width of the arch part may amount to 120 mm, from which it follows that the width of the individual bulge then amounts to approx. 36 mm.

Reference is now made to FIGS. 4-9, which in detail illustrate the muff coupling according to the invention. More precisely, the flange design on the extension tube 2 is shown in FIGS. 4-6 (the second tube 3 has an analogous flange design and is therefore not shown separately), while FIGS. 7-9 illustrate the geometrical design of one of the arch parts 9, which together with a similar arch part form a continuous muff.

In accordance with the invention, the component tube 2 is formed with two (or more) axially spaced-apart flanges 13, 13', each of which individually includes an obliquely inclined shoulder surface 18, 18'. In an analogous way, the arch part 9 is, as is seen in FIG. 9, formed with two pairs of axially spaced-apart bulges 14, 14', each of which individually is less projecting than the solitary bulge 14 that characterizes the previously known muff coupling according to FIG. 12, and each of which individually includes an obliquely inclined or conical side surface 17, 17'. The pairs of conical contact surfaces 17, 17' are inter-parallel to and inclined at an angle $\alpha$ in relation to the plane designated P, which extends perpendicularly to the centre axis C. In the example, the same angle $\alpha$ amounts to 15°, i.e., the cone angle of the surface amounts to 150° (2×75°). Said cone angle may vary, but should be within the range of 140-160°. As is seen in FIG. 6, also the cone surfaces 18, 18' serving as contact surfaces on the flanges 13, 13' are inter-parallel to and inclined at the same angle α as the cone surfaces 17, 17'.

Between the two flanges 13, 13', a peripherical groove 22 is present, which is delimited by the contact surface 18, as well as a first clearance surface 22', which extends at an acute angle β to the surface 18. In the example, this angle β amounts to 68°. In an analogous way, a groove 24 is present between the bulges 14, 14', which groove is delimited by the cone surface 17', as well as by a second clearance surface 23, which with the surface 17' forms an angle χ that is smaller than the angle β and that in the example amounts to 65.5°. Said angular difference (68−65.5=2.5°) means that the surfaces 22', 23 clear from each other and form a play when the arch parts 9 are clamped against each other and surround the flange pairs on the respective component tube. Furthermore, measures have been taken so that the two cylindrical back surfaces 25 on the flanges 13, 13' should not touch the bottom in the groove 24 and the flute 15, respectively, in the muff. Thus, the two back surfaces 25 have an outer diameter D1 that is smaller than the corresponding inner diameters D2 and D3, respectively, in the arch part. In the concrete embodiment example, D1 amounts to 150 mm, while D2=155 mm and D3 =152.7 mm. Furthermore, in the example the diameter D4 of the groove 22 is 140 mm, while the inner diameter D5 of the bulges 14, 14' amounts to 143 mm. By this geometry, it is guaranteed that contact between the muff and the flanges of the component tubes solely takes place via the conical contact surfaces 17, 17', 18, 18'.

In a way known per se, the two component tubes 2, 3 are formed with one or more semi-cylindrical recesses 27, which co-operate with one or more projections 28 (see FIG. 3) on the inside of the muff. In the example, each arch part 9 includes such a projection 28, and the tubes 2, 3 include two diametrically opposed recesses 27. When the muff is tightened and surrounds the flange pairs, the projections 28 guarantee a rigid joint between the tubes. The individual projection 28 is mounted in a bore 29 located in the middle of the arch part 9 (see FIG. 9), in connection with which there is a countersink 30 via which water may be drained away, if the arch part in question forms the lower part in the composed muff 8.

By the fact that forces can be transferred between the muff 8 and the individual component tubes 2, 3 via two axially spaced-apart contact surfaces instead of only one such, the flanges of the component tubes as well as the inner bulges of the muff may be made less projecting than the corresponding flanges and bulges, respectively, in the muff couplings of previously known couplers without the total force-transferring surface being reduced. On the contrary, the total force-transferring contact surface may even be increased in spite of the radius size of the flanges and of the bulges having been decreased. This reduction of the radius size of the flanges and of the bulges means that the outer peripheries of the contact surfaces are located closer to the center axis C of the coupler; something which in turn means that the train of forces or lines of forces between the cylinder walls of the component tubes and the muff will occur in passages located at a minimum radial distance from the center axis C, i.e., considerably closer to the envelope surfaces or cylinder walls of the tubes than in the known muff couplings according to FIG. 12. Furthermore, the transfer of force is distributed to a plurality of axially spaced-apart contact places in the form of the pairs of cone surfaces 17, 18; 17', 18' pressed against each other. Taken together, these factors result in the fact that the amount of material in the two arch parts of the muff may be substantially reduced. The embodiment shown in FIGS. 7-9 of the muff—which in terms of performance even surpasses the known embodiment according to FIG. 12—could accordingly be formed with a width B (the distance between the end surfaces 21) of only 75 mm (to compare with 120 mm in the known embodiment). The material reduction achieved in this way decreases the total weight of the muff to about 6.5 kg (3.25 kg/arch part), which is to be compared with 12 kg according to prior art.

The described muff coupling may in practice be used not only for coupling of individual components in one and the same coupler, but also for coupling of two different couplers of semi-permanent type. Irrespective of the case of use, the above-described muff coupling implies that each one of the two parts that is to be coupled together has pairs of flanges that fit or match the two pairs of inner bulges in the muff. At least during a period of introduction this could lead to problems, for instance when a railway-carriage having a coupler according to the invention should be coupled together with a carriage having a coupler of the older type, or if a component existing in stock should be coupled together with a new component made in accordance with the invention with the purpose of forming a coupler. In order to solve this problem during at least a transition period, two alternative embodiments are foreseen, which schematically are illustrated in FIGS. 10 and 11.

Thus, in FIG. 10 an embodiment is shown according to which the arch parts 9 of the muff include a single bulge 14 for co-operation with a single flange on a part 2 (e.g., an existing, stock-kept component or a coupler of older type), as well as a pair of bulges 14, 14' made in accordance with the invention for co-operation with a corresponding number of flanges 13, 13' on the part 3. Thus, transfer of force between the part 2 and the muff will be effected via single contact surfaces, while the transfer of force between the muff and the part 3 is effected via doubled contact surfaces.

In FIG. 11, it is shown how the invention also may be realized by means of a particular distance piece 31 in combination with a muff of older type. In this case, the pair of bulges 14, 14' that directly co-operate with the pair of flanges 13, 13' are formed on the inside of the distance piece 31, while the outside of the same is formed with a single contact surface that is obliquely inclined or conical and arranged to co-operate with the single, obliquely inclined contact surface 17 on the inside of the muff.

Feasible Modifications of the Invention

The invention is not only limited to the embodiments described above and shown in the drawings. Thus, it is feasible to form the individual component with more than two axially spaced-apart connecting flanges and form the arch parts of the muff with a corresponding number of inner, axially spaced-apart bulges. In this connection, it should also be pointed out that the muff may be composed of more than two arch parts, even if the number of two is preferred.

The invention claimed is:

1. A muff coupling in a rail-mounted vehicle coupler, for interconnecting vehicles, comprising two vehicle coupler components having ends formed with ring-shaped flanges and being interconnectable end-to-end via a muff, the muff comprising:

two arch parts tightenable against each other, each arch part having an inner flute formed between two inwardly turned bulges, which flute is delimited by a bottom and two opposite, force-transferring side surfaces, which side surfaces are obliquely inclined or conical in order to, upon radial tightening of the arch parts against each other, be pressed against analogously obliquely inclined or conical shoulder surfaces on said flanges and thereby, by wedge action, transfer axial component forces to the same with the purpose of pressing the ends of the vehicle coupler components in close contact against each other, wherein, at least one of said vehicle coupler components, in addition to a first flange having a first shoulder surface, includes a second flange axially spaced-apart from the first flange and having a second, obliquely inclined shoulder surface, and each arch part having, in the corresponding end, a first force-transferring side surface axially spaced-apart from a second force-transferring side surface, wherein forces that directly or indirectly are transferred from the two analogously obliquely inclined side surfaces on the arch parts are distributed to both the shoulder surfaces on the vehicle coupler component in an axial train of forces near the outside of the vehicle coupler component.

2. The muff coupling according to claim 1, wherein the two force-transferring side surfaces are formed directly in the two arch parts on first and second, axially spaced-apart bulges.

3. The muff coupling according to claim 2, wherein the two flanges in a pair of flanges are located in the immediate vicinity of each other and spaced-apart by a cross-section-wise V-shaped groove.

4. The muff coupling according to claim 2, wherein the shoulder surfaces of the flanges are conical and inclined in one and the same angle (α) within the range of 10-20° in relation to a radial plane perpendicular to a geometrical center axis (C) through the component.

5. The muff coupling according to claim 2, wherein, each one of the two vehicle coupler components includes a pair of flanges together with the appurtenant shoulder surfaces, and the arch parts at opposite ends include pairs of first and second bulges having side surfaces arranged to co-operate with said pairs of shoulder surfaces on the flanges.

6. The muff coupling according to claim 5, wherein the two flanges in a pair of flanges are located in the immediate vicinity of each other and spaced-apart by a cross-section-wise V-shaped groove.

7. The muff coupling according to claim 5, wherein the shoulder surfaces of the flanges are conical and inclined in one and the same angle (α) within the range of 10-20° in relation to a radial plane perpendicular to a geometrical center axis (C) through the component.

8. The muff coupling according to claim 1, wherein the two force-transferring side surfaces are located on an inside of an arched distance piece on the outside of which a single external, obliquely inclined shoulder surface is formed, arranged to co-operate with a single internal side surface on the arch parts.

9. The muff coupling according to claim 8, wherein the two flanges in a pair of flanges are located in the immediate vicinity of each other and spaced-apart by a cross-section-wise V-shaped groove.

10. The muff coupling according to claim 8, wherein the shoulder surfaces of the flanges are conical and inclined in one and the same angle (α) within the range of 10-20° in relation to a radial plane perpendicular to a geometrical center axis (C) through the component.

11. The muff coupling according to claim 1, wherein the two flanges in a pair of flanges are located in the immediate vicinity of each other and spaced-apart by a cross-section-wise V-shaped groove.

12. The muff coupling according to claim 11, wherein the shoulder surfaces of the flanges are conical and inclined in one and the same angle (α) within the range of 10-20° in relation to a radial plane perpendicular to a geometrical center axis (C) through the component.

13. The muff coupling according to claim 1, wherein the shoulder surfaces of the flanges are conical and inclined in one and the same angle (α) within the range of 10-20° in relation to a radial plane perpendicular to a geometrical center axis (C) through the component.

14. The muff coupling according to claim 1, further comprising a projection rising from said inner flute and cooperating with a semi-cylindrical recess formed in the end of each vehicle coupler component.

15. The muff coupling according to claim 1, wherein the two force-transferring side surfaces are formed directly in the two arch parts.

16. A muff coupling in a vehicle coupler, for interconnecting rail-mounted vehicles, that comprises two vehicle coupler components having ends formed with ring-shaped flanges and being interconnectable end-to-end via a muff, the muff comprising:

two arch parts tightenable against each other, each arch part having an inner flute formed between two inwardly turned bulges, which flute is delimited by a bottom and two opposite, force-transferring side surfaces, which side surfaces are obliquely inclined or conical in order to, upon radial tightening of the arch parts against each other, be pressed against analogously obliquely inclined or conical shoulder surfaces on said flanges and thereby, by wedge action, transfer axial component forces to the same with the purpose of pressing the ends of the vehicle coupler components in close contact against each other, wherein, at least one of said vehicle coupler components, in addition to a first flange having a first shoulder surface, includes a second flange axially spaced-apart from the first flange and having a second, obliquely inclined shoulder surface, wherein forces that directly or indirectly are transferred from the two analogously obliquely inclined side surfaces on the arch parts are distributed to both the shoulder surfaces on the vehicle coupler component in an axial train of forces near the outside of the vehicle coupler component, and the two force-transferring side surfaces are formed on an inside of an arched distance piece on the outside of which piece a single external, obliquely included should surface is formed, arranged to co-operate with a single internal side surface on the arch parts.

17. The muff coupling according to claim 16, wherein the two flanges in a pair of flanges are located in the immediate vicinity of each other and spaced-apart by a cross-section-wise V-shaped groove.

18. The muff coupling according to claim 16, wherein the shoulder surfaces of the flanges are conical and inclined in one and the same angle (α) within the range of 10-20° in relation to a radial plane perpendicular to a geometrical center axis (C) through the component.

19. The muff coupling according to claim 17, wherein the shoulder surfaces of the flanges are conical and inclined in one and the same angle (α) within the range of 10-20° in relation to a radial plane perpendicular to a geometrical center axis (C) through the component.

* * * * *